US008922973B1

(12) United States Patent
Elizondo-Decanini

(10) Patent No.: US 8,922,973 B1
(45) Date of Patent: Dec. 30, 2014

(54) DETONATOR COMPRISING A NONLINEAR TRANSMISSION LINE

(71) Applicant: Sandia Corporation, Albuquerque, NM (US)

(72) Inventor: Juan M. Elizondo-Decanini, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 23 days.

(21) Appl. No.: 14/010,157

(22) Filed: Aug. 26, 2013

(51) Int. Cl.

| | |
|---|---|
| ***F23Q 7/00*** | (2006.01) |
| ***F23Q 7/02*** | (2006.01) |
| ***F42D 1/045*** | (2006.01) |
| ***F42D 1/05*** | (2006.01) |

(52) U.S. Cl.
CPC ..... *F42D 1/05* (2013.01)
USPC ..... 361/251; 102/200; 102/206

(58) Field of Classification Search
USPC ..... 361/251; 102/200, 206
See application file for complete search history.

(56) References Cited

U.S. PATENT DOCUMENTS

| | | | | |
|---|---|---|---|---|
| 6,690,247 | B2 | 2/2004 | Kintis et al. | |
| 7,339,440 | B2 * | 3/2008 | Ricketts et al. | 331/107 SL |
| 7,532,083 | B2 | 5/2009 | Hannah | |
| 7,733,194 | B2 | 6/2010 | Lan et al. | |
| 8,154,354 | B2 * | 4/2012 | Ricketts et al. | 331/107 DP |
| 8,261,663 | B2 | 9/2012 | Perez Cordova et al. | |
| 8,564,385 | B2 * | 10/2013 | Scott et al. | 333/242 |
| 2012/0079956 | A1 | 4/2012 | Juras, III | |
| 2012/0227608 | A1 | 9/2012 | Givens et al. | |
| 2012/0242192 | A1 * | 9/2012 | Baird et al. | 310/319 |

OTHER PUBLICATIONS

Rossi, J.O.; Silva Neto, L.P.; Yamasaki, F.S.; Schamiloglu, E., "Prospects of building capacitive nonlinear lines using ceramic PZT for high-frequency operation," Power Modulator and High Voltage Conference (IPMHVC), 2012 IEEE International , vol., no., pp. 752,755, Jun. 3-7, 2012.*

* cited by examiner

*Primary Examiner* — Scott Bauer
(74) *Attorney, Agent, or Firm* — Michael A. Beckett

(57) ABSTRACT

Detonators are described herein. In a general embodiment, the detonator includes a nonlinear transmission line that has a variable capacitance. Capacitance of the nonlinear transmission line is a function of voltage on the nonlinear transmission line. The nonlinear transmission line receives a voltage pulse from a voltage source and compresses the voltage pulse to generate a trigger signal. Compressing the voltage pulse includes increasing amplitude of the voltage pulse and decreasing length of the voltage pulse in time. An igniter receives the trigger signal and detonates an explosive responsive to receipt of the trigger signal.

20 Claims, 7 Drawing Sheets

DETONATOR COMPRISING A NONLINEAR TRANSMISSION LINE

STATEMENT OF GOVERNMENTAL INTEREST

This invention was developed under contract DE-AC04-94AL85000 between Sandia Corporation and the U.S. Department of Energy. The U.S. Government has certain rights in this invention.

BACKGROUND

Conventional detonators comprise an igniter (such as a bridge wire or fuse) that is configured to emit a relatively large pulse of energy responsive to receipt of a trigger signal. The trigger signal has a predefined shape (e.g., rise time and amplitude). Trigger signals typically have a relatively fast rise time, wherein the trigger signal burns a wire bridge or fuse, which then detonates an explosive (such as trinitrotoluene, nitrogen trichloride, cyclonite, cyclotrimethylene trinitramine, etc.).

Conventional detonator designs are based upon a capacitor and a switch. A battery is employed to charge the capacitor, and the switch is timed such that the trigger signal is output, thereby causing the bridge wire or fuse to burn as rapidly as possible. The rapid burning of the bridge wire or fuse generates a concentrated burst of energy, which impacts an explosive coupled to the detonator. Such burst of energy may be in the form of heat, a shock wave, etc.

Conventional detonators are problematic in that faulty switches and/or faulty capacitors may cause the detonator to malfunction, such that a detonator can cause an explosive to detonate at an unexpected time (e.g., later than expected) or not at all. It can be ascertained that, particularly for relatively complex explosive operations (such as large building demolition in populated areas), timing of detonation of explosives must be precise to ensure safety of explosives operators and minimize damage to other structures. These more complex explosive operations generally include the use of control centers that are located several hundred feet from a demolition site. Due to the need for precise timing, the remote location of the control center, and the distributed nature of explosives, a relative complex explosive operation can include use of multiple detonators placed at particular locations, each detonator having its own respective timing switch and capacitor charge unit. Conventionally, to avoid unintentionally detonating an explosive, a charging system for a detonator is grounded until immediately before the explosive is detonated, and thereafter a capacitor unit is relatively slowly charged. The problem of malfunctioning switches and/or capacitors is addressed with redundant switches/capacitors and backup systems.

SUMMARY

The following is a brief summary of subject matter that is described in greater detail herein. This summary is not intended to be limiting as to the scope of the claims.

Described herein in alternative embodiments are various technologies pertaining to detonators including a nonlinear transmission line that can be configured to receive a voltage pulse as input and output a trigger signal responsive to receipt of the voltage pulse, wherein the voltage pulse is compressed to generate the trigger signal. Compression of the voltage pulse includes increasing amplitude of the voltage pulse and increasing velocity of the voltage pulse (e.g., decreasing length of the pulse in time). Generation of the trigger signal is based upon the nonlinear transmission line having a variable capacitance, wherein capacitance of the nonlinear transmission line is a function of voltage on the nonlinear transmission line. In an exemplary embodiment, as the voltage on the nonlinear transmission line increases, the capacitance of the nonlinear transmission line can decrease. In another exemplary embodiment, as the current on the nonlinear transmission line increases, the capacitance of the nonlinear transmission line can increase.

Such a nonlinear transmission line is particularly well-suited for a variety of applications. For example, a detonator can include a nonlinear transmission line, wherein the detonator comprises an igniter (e.g., a fuse or bridge wire) that is ignited responsive to receiving a trigger signal from the nonlinear transmission line. In another example, the nonlinear transmission line can be included in a radiography system that emits a burst of radiation responsive to receipt of a trigger signal. As the nonlinear transmission line is configured to compress an input voltage pulse, less energy can be needed to generate the trigger signal.

In an exemplary embodiment, the nonlinear transmission line can include at least one variable capacitor, wherein the variable capacitor has a capacitance that is a function of voltage on the capacitor. For instance, when multiple variable capacitors are connected in series, as voltage on the nonlinear transmission line increases, capacitance of the nonlinear transmission line can decrease. In another example, when multiple variable capacitors are connected in parallel in the nonlinear transmission line, as voltage on the nonlinear transmission decreases, current on the nonlinear transmission line increases.

In an example, a variable capacitor can be included as a lumped element in the nonlinear transmission line. The variable capacitor can include a plurality of layers, wherein such layers comprise a plurality of layers of dielectric material and a plurality of layers of metal oxide material and/or ferroelectric material. Each layer of metal oxide material and/or ferroelectric material is respectively interposed between layers of dielectric material, such that the variable capacitor is formed by alternating layers of dielectric material and metal oxide material and/or ferroelectric material.

In an example, the variable capacitor can be formed by way of axially stacking such layers or radially stacking such layers. For instance, when the layers are radially stacked, the variable capacitor can comprise a plurality of concentric rings. The thicknesses of each layer of metal oxide material and/or ferroelectric material are respectively selected such that the layers of metal oxide material and/or ferroelectric material become conductive at particular voltages. When a layer of metal oxide material and/or ferroelectric material becomes conductive, the layers of dielectric material surrounding the layer of metal oxide material and/or ferroelectric material become connected in series, thereby reducing overall capacitance of the variable capacitor. It can, therefore, be ascertained that a number and thickness of layers of the variable capacitor can be manufactured to cause a particular input voltage pulse to be compressed to form a trigger signal having a desired rise time/shape (with a minimum predefined amplitude).

In another exemplary embodiment, the nonlinear transmission line can include a nanoparticle-modified complex dielectric material, wherein distribution of conductive nanoparticles in the complex dielectric material corresponds with a capacitance that alters as a function of voltage. With more specificity, an input voltage pulse can be compressed by changing a local value of a material dielectric constant (and thus intrinsically, the capacitance) as the input voltage pulse travels through the nonlinear transmission line. The material dielectric constant can be modified by leveraging the conductivity portion of a complex dielectric constant value, which becomes frequency dependent, thus introducing a strong nonlinear behavior (and thereby inducing pulse compression). Accordingly, a dielectric material can be manufactured to have conductive nanoparticles distributed therein in accordance with a predefined distribution. Such dielectric material can be included in a transmission line, thereby forming a nonlinear transmission line.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
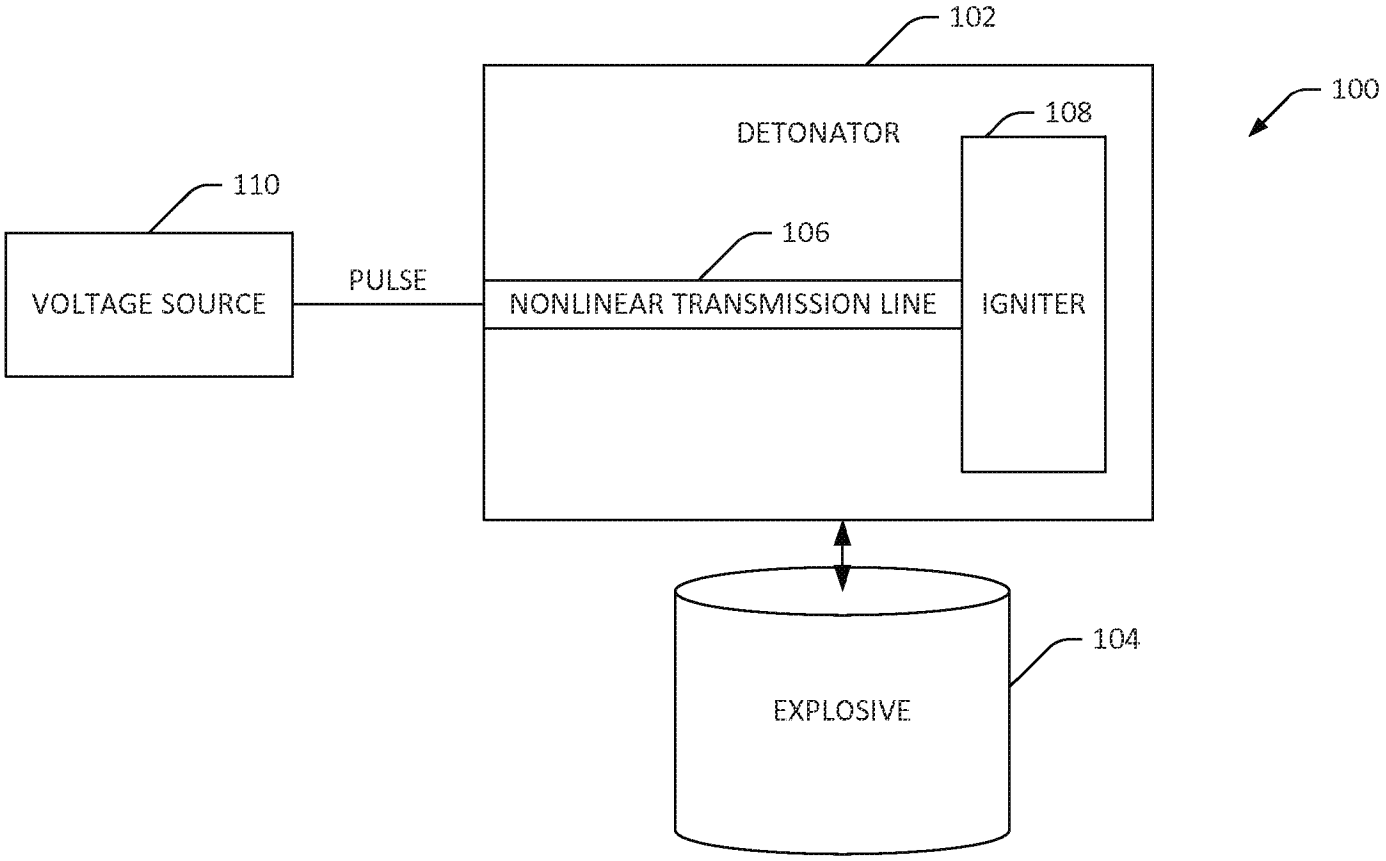
FIG. 1 is a functional block diagram of an exemplary detonator that comprises a nonlinear transmission line.

In alternative embodiments, various technologies pertaining to detonators having a nonlinear transmission are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

With reference now to FIG. 1, in a general embodiment, an exemplary explosives system 100 is illustrated. The explosives system 100 includes a detonator 102, which is configured to detonate an explosive 104. The explosive 104 can be composed of any suitable primary or secondary explosive material, such as trinitrotoluene, nitrogen trichloride, cyclonite, cyclotrimethylene trinitramine, etc. The detonator 102 includes a nonlinear transmission line 106 that has a capacitance that varies as a function of voltage on the nonlinear transmission line 106. For example, capacitance of the nonlinear transmission line 106 can decrease as voltage on the nonlinear transmission line 106 increases. In another example, the nonlinear transmission line 106 can be configured such that as the voltage of the nonlinear transmission line 106 decreases, current on the nonlinear transmission line 106 increases. As will be described in greater detail below, the nonlinear transmission line 106 can comprise a variable capacitor, wherein capacitance of the variable capacitor alters as a function of voltage on the variable capacitor. In another example, the nonlinear transmission line 106 can include a dielectric or thermoset material that has conductive (e.g., metallic) nanoparticles distributed therein, such that the capacitance of the nonlinear transmission line 106 alters as a function of the distribution of the metallic nanoparticles.

The detonator 102 further includes an igniter 108 that is configured to emit an energy pulse responsive to receipt of a trigger signal from the nonlinear transmission line 106. Pursuant to an example, the igniter 108 may be a bridge wire or a fuse. Energy emitted by the igniter 108 may be heat, a shockwave, or the like, wherein a type of energy emitted by the igniter 108 can depend upon a type of the explosive 104. The igniter 108 causes the explosive 104 to detonate responsive to the igniter 108 receiving the trigger signal from the nonlinear transmission line 106.

The explosive system 100 can further include a voltage source 110, which may be a DC voltage source such as a battery, capacitor, etc. The voltage source 110 is configured to output an input voltage pulse, which is received at the nonlinear transmission line 106. In operation, the nonlinear transmission line 106 compresses the input voltage pulse to generate the trigger signal, which is received by the igniter 108. Compression of the input voltage pulse to generate the trigger signal comprises increasing amplitude of the input voltage pulse and increasing velocity of the input voltage pulse, thereby decreasing the length of the pulse in time.

In an exemplary embodiment, the igniter 108 can be configured to detonate the explosive 104 responsive to the igniter 108 receiving a trigger signal that has a particular rise time and a certain shape, wherein the rise time and shape can be modeled by way of a first equation. Similarly, the voltage source 110 can be configured to output the input voltage pulse, wherein the input voltage pulse has a particular rise time and shape that can be modeled by of a second equation. The nonlinear transmission line 106 can be designed (customized) to effectively transform the second equation into the first equation; that is, the nonlinear transmission line 106 can be designed to receive the input voltage pulse from the voltage source 110 and compress the input voltage pulse to cause the pulse to have the rise time and shape that corresponds to the first equation. Again, when the igniter 108 receives such pulse (the trigger signal), the igniter 108 releases energy, thereby detonating the explosive 104.

As the nonlinear transmission line 106 is designed in accordance with both the voltage source 110 and the igniter 108, risk of malfunction of the detonator 102 is mitigated. For example, an electrostatic discharge most likely will not match the input voltage source required to cause the nonlinear transmission line 106 to output the trigger signal. Additionally, since the nonlinear transmission line 106 can be configured to increase the amplitude of the input voltage pulse, the voltage source 110 can be configured to output a voltage pulse with lower amplitude when compared with conventional explosive systems. Therefore, an amount of energy needed to detonate the explosive 104 is reduced when compared to energy needed to detonate explosives in conventional explosives systems. Still further, the detonation system 100 overcomes deficiencies associated with timing requirements of conventional explosive systems. As noted above, conventional explosive systems include the use of switches to produce a trigger signal having the requisite rise time needed to ignite an igniter, wherein charging of a capacitor and operation of the switch need to be precisely timed to generate the desired trigger signal. In the exemplary detonation system 100, switches are unnecessary. That is, the nonlinear transmission line 106 can be configured to intrinsically compress the voltage pulse output by the voltage source 110 to generate the trigger signal for the igniter 108. Similarly, if the nonlinear transmission line 106 includes a plurality of variable capacitors arranged in parallel, the nonlinear transmission line 106 can be configured to intrinsically compress a current pulse output by the voltage source 110 to generate a trigger signal for the igniter 108.

Figure 2:
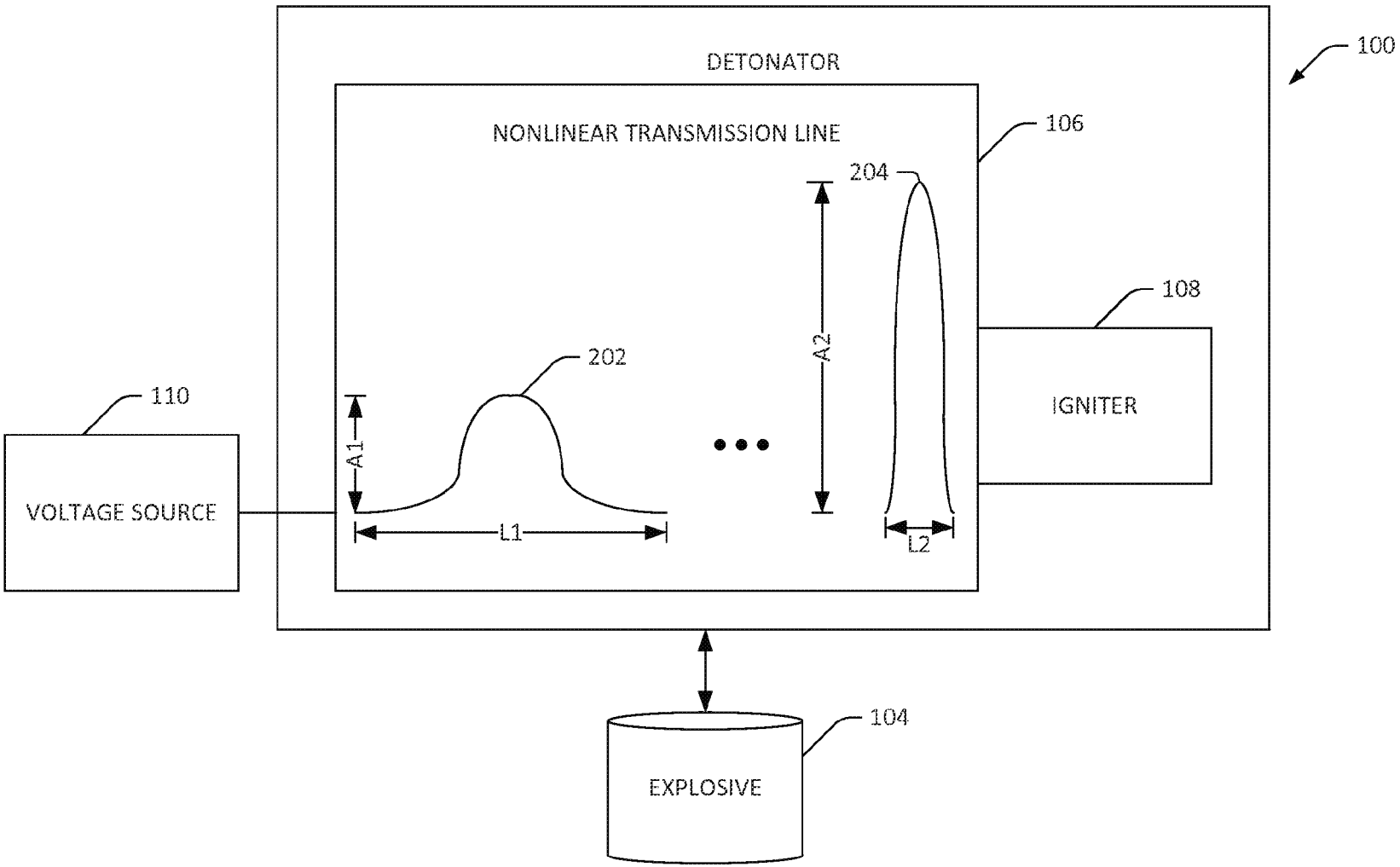
FIG. 2 illustrates an input voltage pulse being compressed as it travels along a nonlinear transmission line.

Now referring to FIG. 2, another exemplary depiction of the explosive system 100 is illustrated. In operation, the voltage source 110 outputs a voltage pulse 202 having a first amplitude A1 and a first pulse length L1. As the voltage pulse 202 travels through the nonlinear transmission line 106, the voltage pulse 202 is compressed, thereby generating a trigger signal 204, wherein the trigger signal has a second amplitude A2 and a second pulse length L2. As noted above, compression of the voltage pulse 202 comprises increasing amplitude of the voltage pulse 202 (e.g., A2>A1) and increasing velocity of the voltage pulse 202, thereby reducing the pulse length in time (e.g., L2<L1). The nonlinear transmission line 106 compresses the input signal 202 based upon the variable capacitance of the nonlinear transmission line 106. For example, as the front end of the voltage pulse 202 enters the nonlinear transmission line 106, the nonlinear transmission line 106 will have a first capacitance associated therewith. As the voltage pulse 202 further travels along the nonlinear transmission line 106, and as the voltage of the voltage pulse 202 increases over time, the capacitance of the nonlinear transmission line 106 decreases, resulting in compression of the voltage pulse 202 to form the trigger signal 204. As indicated above, the variable capacitance of the nonlinear transmission line 106 can be engineered to cause the resultant trigger signal 204 to have a rise time and shape that causes the igniter 108 to emit a pulse of energy, thereby detonating the explosive 104.

As will be described in greater detail below, the nonlinear transmission line 106 can be composed of a plurality of variable (nonlinear) capacitors and regular inductors in a series of L-C pairs. A number of L-C pairs can depend upon a desired input to output compression ratio and voltage/current characteristics. In an exemplary embodiment, the variable capacitors have a first terminal coupled to grounded, and as the voltage pulse travels through a side of the capacitor that opposes the first terminal the capacitance of the nonlinear transmission line 106 will change (e.g., increase or decrease depending upon whether the variable capacitor is connected in series or parallel with other variable capacitors). Described below is a detailed description pertaining to a series capacitance connection, where capacitance decreases as voltage increases (e.g., beginning with a parallel connection), as the voltage induces conduction in each metal oxide layer of a variable capacitor. A similar process is obtained starting with series connection and changing to parallel (higher capacitance) as the voltage pulse travels through the nonlinear transmission line 106.

Figure 3:
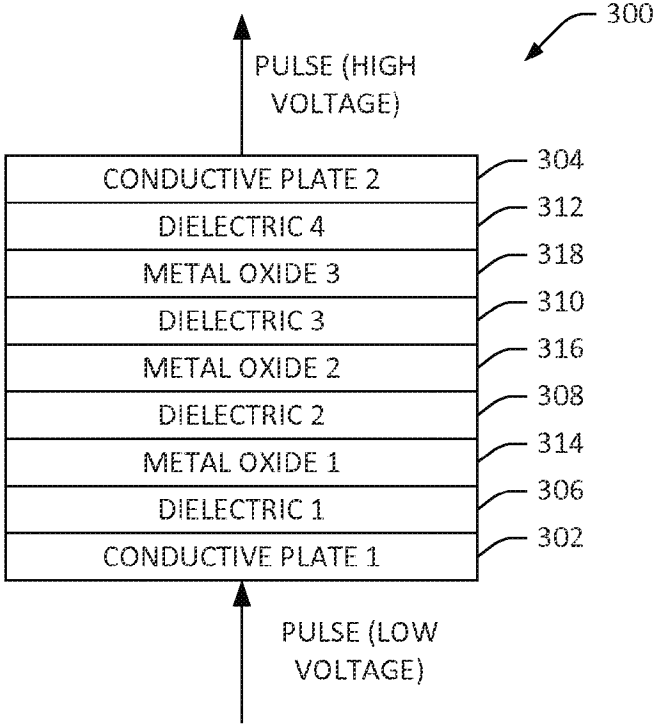
FIG. 3 illustrates an exemplary variable capacitor that can be included in a nonlinear transmission line.

With reference now to FIG. 3, an exemplary variable capacitor 300 is illustrated. For example, the nonlinear transmission line 106 can include a plurality of variable capacitors as lumped elements therein. The exemplary variable capacitor 300 comprises a first conductive plate 302 and a second conductive plate 304. The first conductive plate 302 corresponds to an input (e.g., high voltage) terminal of the variable capacitor 300, and the second conductive plate 304 corresponds to an output (or grounded) terminal of the variable capacitor 300. The variable capacitor 300 further comprises a plurality of layers of dielectric material 306-312, wherein the dielectric material may be a ceramic, a plastic, a glass, or other suitable dielectric material. For instance, the dielectric material may be barium titanate. The variable capacitor 300 additionally comprises a plurality of layers of metal oxide material 314-318, wherein each layer of metal oxide material in the plurality of layers of metal oxide material 314-318 is respectively interposed between a pair of layers of dielectric material, such that the variable capacitor 300 includes alternating layers of dielectric material and metal oxide material. With more particularity, the first layer of metal oxide material 314 is interposed between the first layer of dielectric material 306 and the second layer of dielectric material 308, the second layer of metal oxide material 316 is interposed between the second layer of dielectric material 308 and the third layer of dielectric material 310, and the third layer of metal oxide material 318 is interposed between the third layer of dielectric material 310 and the fourth layer of dielectric material 312. The metal oxide material, in an exemplary embodiment, may be zinc oxide, although the hereto-appended claims are not so limited. Furthermore, the plurality of layers of metal oxide material 314-318 may be replaced with layers of ferroelectric material. In still yet another exemplary embodiment, the variable capacitor 300 may include layers of dielectric material, layers of metal oxide material, and layers of ferroelectric material.

While the variable capacitor 300 is shown as including four layers of dielectric material and three layers of metal oxide material, it is to be understood that the variable capacitor 300 can include more or fewer layers of dielectric material and metal oxide material. For instance, the variable capacitor 300 may include any number of layers of dielectric material greater than one, and may include any number of layers of metal oxide material greater than zero.

A respective thickness of each layer in the plurality of layers of dielectric material 306-312, and a respective thickness of each layer in the plurality of layers of metal oxide material 314-318, can be selected based upon known characteristics of a desired trigger signal and known characteristics of a voltage source (and thus of a voltage pulse emitted by the voltage source). For example, as indicated above, the igniter 108 may be designed to ignite responsive to receipt of a trigger signal having a particular rise time and pulse shape. Thicknesses of the layers of dielectric material 306-312 and thicknesses of the layers of metal oxide material 314-318 can be selected based upon the desired relationship between voltage and capacitance of the variable capacitor 300. Accordingly, for example, the thicknesses of the aforementioned layers can be selected such that the variable capacitor 300 has a first capacitance when a first voltage is thereon and a second capacitance when a second voltage is thereon.

Additional detail pertaining to operation of the variable capacitor 300 is now set forth. The variable capacitor 300 can be designed to receive an input voltage pulse with an amplitude as low as 1 mV and as high as 10 MV. The metal oxide material from which the layers of metal oxide material 314-318 are composed, and thicknesses of the respective layers of metal oxide material 314-318, are selected such that each layer becomes conductive at a respective voltage. As the input voltage pulse is received at the variable capacitor, voltage thereon increases, such that the metal oxide layers 314-318 are progressively made conductive, thereby coupling the layers of dielectric material 306-312 in series.

With more specificity, as the input voltage pulse is received, a difference in potential between the first conductive plate 302 and the second conductive plate 304 is increased (e.g., initially all metal oxide layers act as non-conductive ceramic and contribute to overall capacitance of the variable capacitor 300). When such potential reaches a point where the first layer of metal oxide material 314 becomes conductive, the first layer of dielectric material 306 and the second layer of dielectric material 308 become connected in series, reducing the capacitance of the variable capacitor 300. As the voltage pulse continues to be received by the variable capacitor 300, a difference in potential between the second metal oxide layer 316 and the second conductive plate 304 increases. When such difference in potential reaches a point where the second layer of metal oxide material 316 becomes conductive, the first layer of dielectric material 306, the second layer of dielectric material 308, and the third layer of dielectric material 310 are coupled in series, further reducing capacitance of the variable capacitor 300.

As the voltage pulse is continued to be received, difference in potential between the third layer of metal oxide material 318 and the second conductive plate 304 increases until the third layer of metal oxide material 318 becomes conductive, thus connecting the layer of dielectric material 306-312 in series, further reducing capacitance of the variable capacitor 300. As the voltage pulse travels through the nonlinear transmission line 106, which can include multiple non-linear capacitors, the voltage pulse compresses every time the pulse moves over a variable capacitor; thus, by a cumulative effect, a desired voltage pulse compression can be achieved, thereby forming the trigger signal. The change in capacitance of the variable capacitor 300 can be made to progress, in time, following a desired equation by properly designing the thicknesses of both the metal oxide and dielectric layers. Moreover, the change in capacitance of the variable capacitor 300 can be made to progress, in time, following a desired equation by properly conforming the variable capacitor 300 to an expected or/desired voltage rise time and waveform shape. As the variable capacitor 300 can be integrated into a transmission line as a lumped element, a variable capacitance—wave velocity nonlinear transmission line can be formed.

The variable capacitor 300 shown in FIG. 3 comprises a plurality of axially stacked layers. Size of such layers may be as small as 1 mm in diameter to several centimeters in diameter, with thicknesses as small as micrometers and as large as 1 cm. Furthermore, while the layers 306-318 are shown as having identical diameters, it is to be understood that diameters of the layers may be made progressively smaller or larger along the stack, depending on the desired shape of the trigger signal output by the nonlinear transmission line 106. Other configurations are also possible, such as rectangular or a shape conforming to a specific application.

Figure 4:
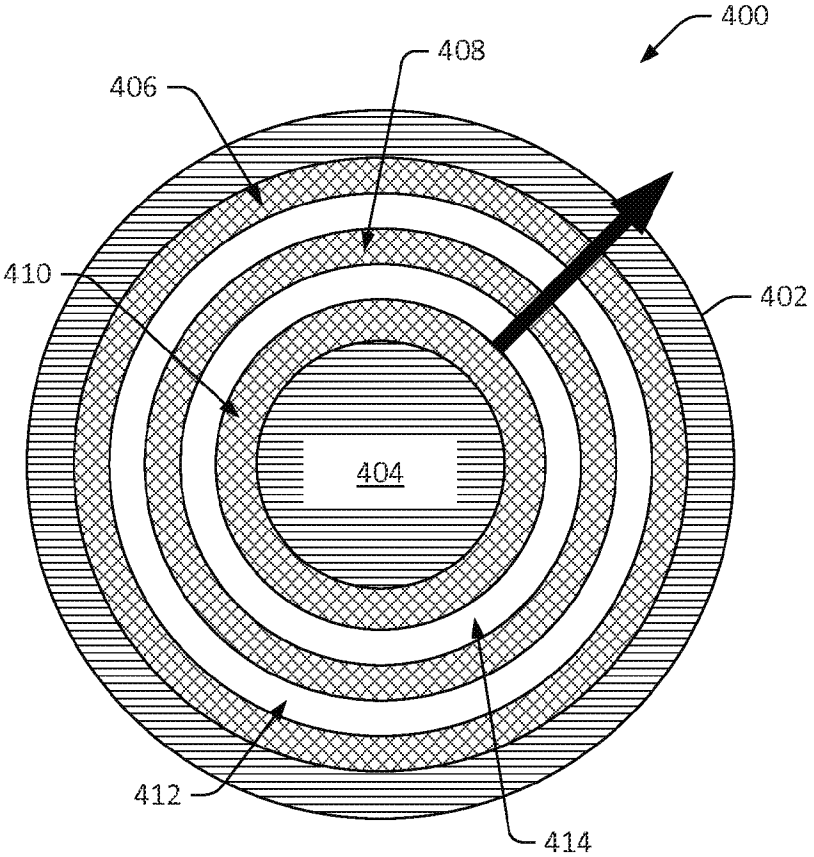
FIG. 4 illustrates another exemplary variable capacitor that can be included in a nonlinear transmission line.

Turning now to FIG. 4, a cross-sectional view of another exemplary variable capacitor 400 is illustrated. The variable capacitor 400 comprises a first conductive surface 402 and a second conductive surface 404, which are analogous to the conductive plates 302-304 of the variable capacitor 300. The variable capacitor 400 further includes plurality of layers of dielectric material 406-410, as well as a plurality of layers of metal oxide material 412-414. As with the variable capacitor 300, the layers of dielectric material 406-410 and the layers of metal oxide material 412-414 alternate, such that each layer of metal oxide material is surrounded by a respective pair of layers of dielectric material.

In the exemplary variable capacitor 400 shown in FIG. 4, the layers 406-414 are stacked radially as concentric rings. In such an embodiment, the voltage pulse that is to be compressed travels axially, with the variable capacitor 400 having a length along its axis, wherein an initial capacitance value can be a function of the length. In an exemplary embodiment, the conductive surface 402 can act as an input (e.g., high voltage) terminal of the variable capacitor 400, and the conductive surface 404 can act as an output (grounded) terminal of the variable capacitor 404. Alternatively, the conductive surface 404 can act as an input (high voltage) terminal of the variable capacitor 400, and the conductive surface 402 can act as the output (grounded) terminal of the variable capacitor 400. The variable capacitor 400 operates in a manner similar to that of the variable capacitor 300, in that, for predefined voltages, the respective metal oxide layers 412-414 become conductive, thereby connecting dielectric layers in series, effectively reducing the overall capacitance of the variable capacitor 400. The thicknesses of the layers 406-414 can be selected such that the capacitance of the variable capacitor 400 changes in time in accordance with an equation that describes the rise time and wave shape of the trigger signal that will result in the igniter 108 igniting, and thus detonating the explosive 104. While the variable capacitor 400 is shown as having a circular shape, it is to be understood that the variable capacitor 400 can be of any suitable shape, including ovular, square, rectangular, etc.

Figure 5:
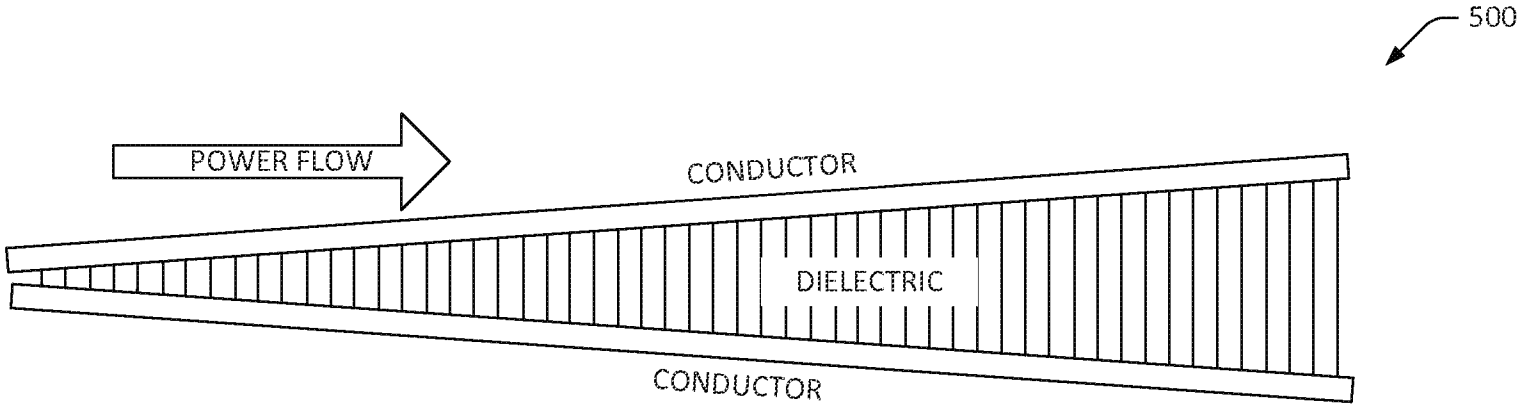
FIG. 5 illustrates an exemplary wedge strip line.

With reference now to FIG. 5, an exemplary wedge-shaped strip line 500 is depicted, wherein capacitance of the strip line 500 is reduced as the thickness of the strip line 500 increases. An input voltage pulse traversing the strip line 500 becomes compressed. The strip line 500 is shown as having a linear (wedge) shape, although it is to be contemplated that such strip line 500 can be manufactured to have a nonlinear shape, such as exponential, elliptical, etc. The strip line 500 is set forth as an illustration to indicate a decrease in capacitance along a length of the strip line 500. Such effect can be accomplished by forming a transmission line that includes a dielectric or thermoset therein, and selectively distributing conductive nanoparticles in the dielectric or thermoset to form a nonlinear transmission line. In an example, the distribution of the nanoparticles in the dielectric or thermoset material may be varying along the length of the transmission line.

For instance, a transmission line can be configured to include a dielectric, thermoset, or other suitable material with a dielectric constant value being greater than one. Between points on the transmission line, a value of the material dielectric constant can be configured to alter, which is the basis for input voltage pulse compression as the input voltage wave travels through the transmission line. In an exemplary embodiment, an alteration in a material dielectric constant can be accomplished by leveraging the conductivity portion of the complex dielectric constant value, which then becomes strongly frequency dependent, and thus introducing a strong nonlinear behavior (thereby inducing pulse compression). Therefore, a transmission line can be manufactured to include a dielectric or thermoset with a metallic nanoparticle mixed therein and distributed in any suitable manner to cause an input voltage pulse to be compressed to form a trigger signal with a desired rise time/wave shape. Thus, conductive metallic nanoparticles can be distributed in a ceramic or thermoset in a linear, nonlinear, exponential or any suitable distribution desired throughout the dielectric, such that an input voltage pulse traveling through the transmission line that includes the dielectric mixed with the metallic nanoparticles compresses to generate the desired trigger signal.

It can be ascertained that the distribution if the nanoparticles determines the pulse compression characteristics of the transmission line. In the case of the strip line 500, the conductivity, and thus the dielectric constant of the material, can be distributed along the length of the strip line 500 following a defined distribution, wherein the distribution is dependent upon the desired shape of the trigger signal. In an exemplary embodiment, an exponential distribution of conductive nanoparticles in a dielectric can result in a pulse that relatively quickly compresses. Further, features of the variable capacitors 300 and 400 can be used in connection with the metallic nanoparticles. For instance, dielectric layers of the variable capacitors can have metallic nanoparticles mixed therein with a certain distribution to further control the resultant shape of the trigger signal.

Figure 6:
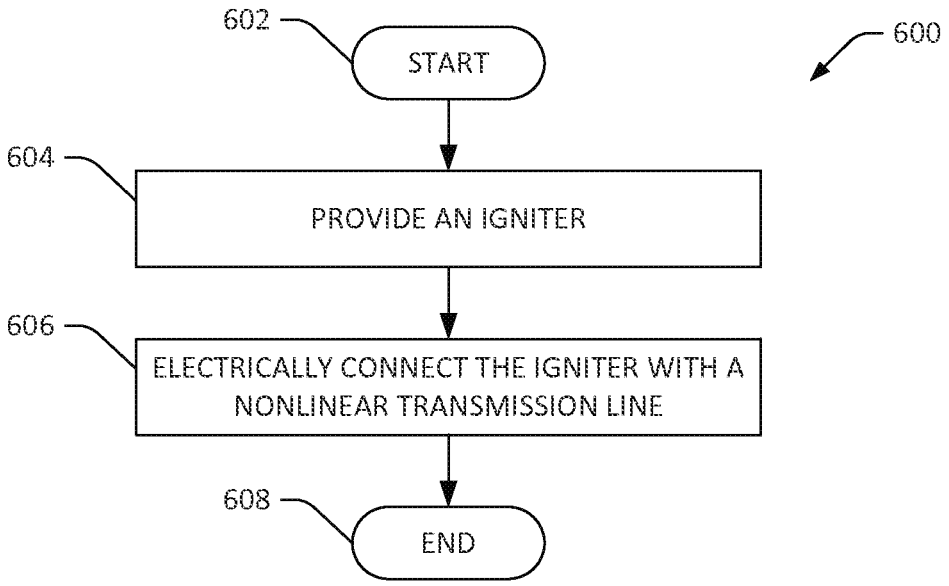
FIG. 6 is a flow diagram illustrating an exemplary methodology for forming a detonator.
Figure 7:
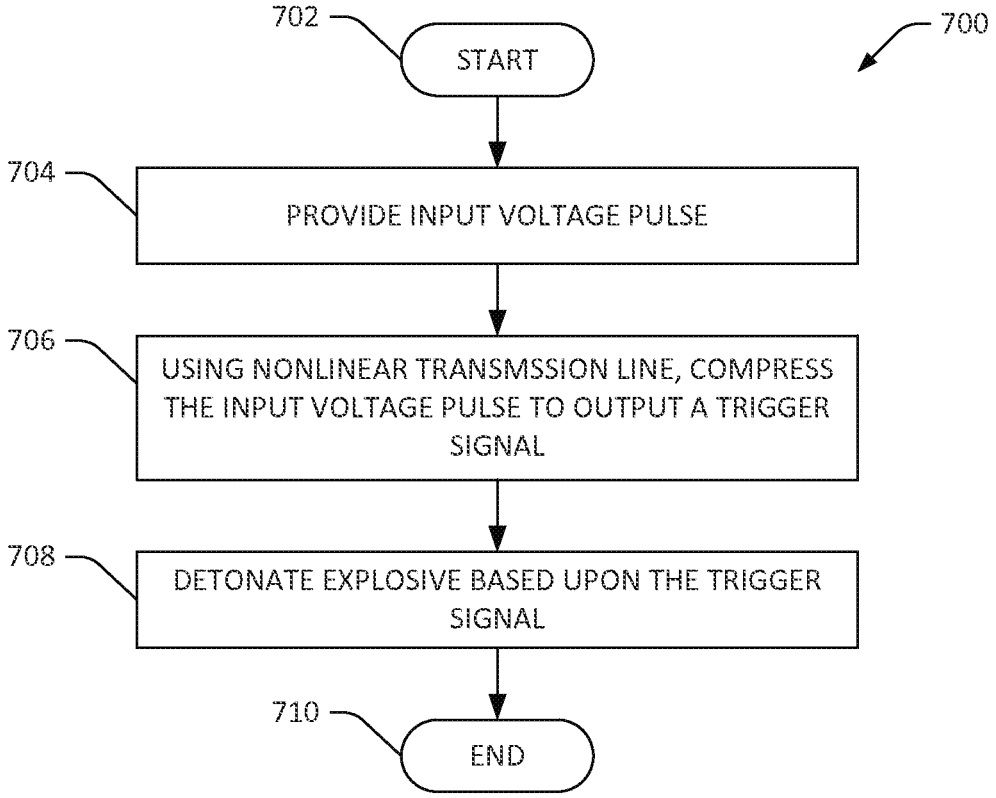
FIG. 7 is a flow diagram illustrating an exemplary methodology for detonating an explosive through utilization of a nonlinear transmission line.
Figure 8:
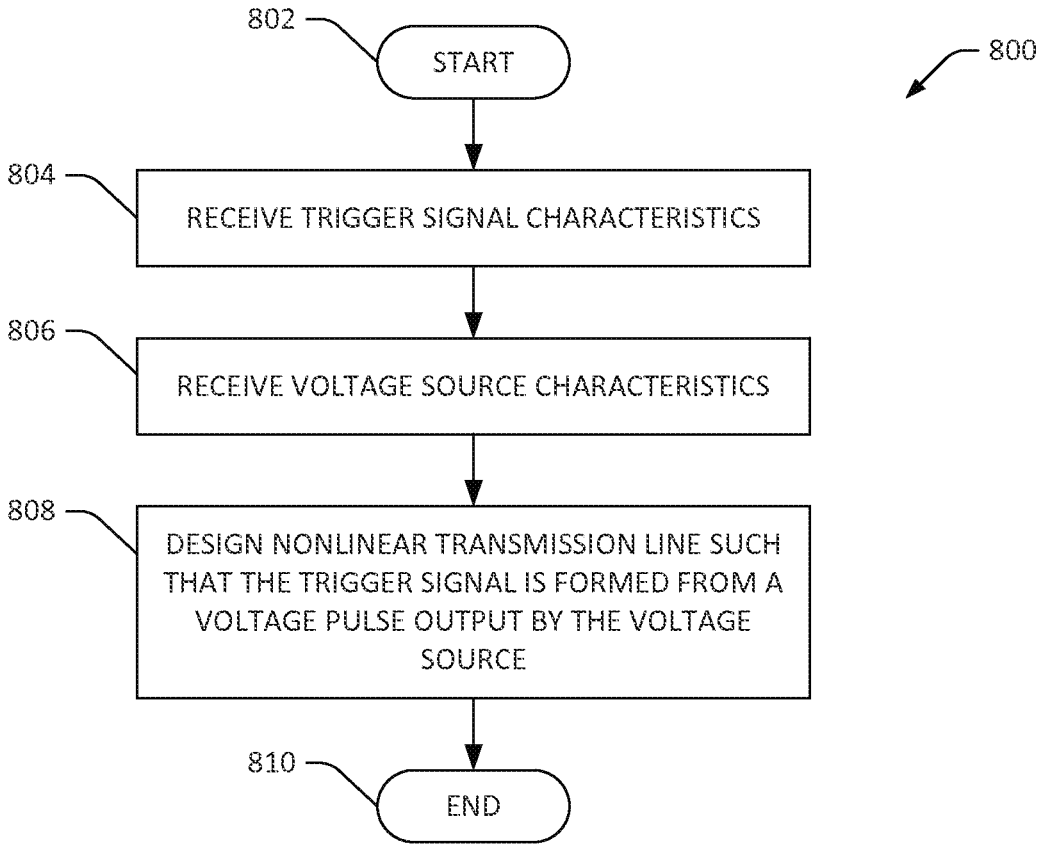
FIG. 8 is a flow diagram illustrating an exemplary methodology for designing a nonlinear transmission line based upon input voltage and trigger signal specifications.

FIGS. 6-8 illustrate exemplary methodologies relating to nonlinear transmission lines. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement a methodology described herein.

Turning now to FIG. 6, an exemplary methodology 600 for forming a detonator is illustrated. The methodology 600 starts at 602, and at 604, an igniter is provided, wherein the igniter may be one of a fuse or a bridge wire.

At 606, the igniter is electrically connected with a nonlinear transmission line. The nonlinear transmission line is configured to output a trigger signal that ignites the igniter. For example, the nonlinear transmission line can have a capacitance that varies as a function of voltage on the nonlinear transmission line, resulting in compression of an input voltage pulse as the voltage pulse traverses the nonlinear transmission line. Thus, the nonlinear transmission line can receive the input voltage pulse and compress the voltage pulse to generate a desired trigger signal. In an exemplary embodiment, the nonlinear transmission line can comprise a variable capacitor, such as the variable capacitor 300 or the variable capacitor 400 set forth above. In another exemplary embodiment, the nonlinear transmission line can include a dielectric or thermoset with metallic nanoparticles distributed therein to cause the capacitance of the nonlinear transmission line to alter as the input voltage pulse travels through the nonlinear transmission line. The methodology 600 completes at 608.

Now referring to FIG. 7, an exemplary methodology 700 for detonating an explosive is illustrated. The methodology 700 starts at 702, and at 704, an input voltage pulse is provided. For instance, such input voltage pulse can be provided from a suitable DC voltage source, such as a battery, capacitor, etc. At 706, a nonlinear transmission line is used to compress the input voltage pulse, thus increasing the amplitude and decreasing the pulse length of the input voltage pulse, thereby forming a trigger signal having a desired rise time/shape. At 708, an explosive is detonated based upon the trigger signal, and the methodology 700 completes at 710.

Turning now to FIG. 8, an exemplary methodology 800 for manufacturing a nonlinear transmission line is illustrated. The methodology 800 starts at 802, and at 804, characteristics of a desired trigger signal are received. Such characteristics can include a rise time of the trigger signal, a shape of the trigger signal, a minimum amplitude of the trigger signal, etc.

At 806, characteristics of a voltage source are received, which can include characteristics of a voltage pulse that can be output by the voltage source. Characteristics of the voltage pulse can include a rise time of the voltage pulse, shape of the voltage pulse, amplitude of the voltage pulse, pulse length, etc.

At 808, a nonlinear transmission line is designed, such that the trigger signal is formed when the voltage source outputs a voltage pulse. For instance, the nonlinear transmission line can be designed to include a variable capacitor comprising a plurality of alternating layers of dielectric material and metal oxide material, wherein thicknesses of such layers are selected based upon the trigger signal characteristics received at 804 and the voltage source characteristics received 806. In another example, the nonlinear transmission line can be designed to include dielectric material with metallic (conductive) nanoparticles distributed therein, wherein distribution of the nanoparticles in the dielectric material causes the nonlinear transmission line to output the trigger signal with the characteristics received at 804 responsive to receipt of a voltage pulse from the voltage source having characteristics received at 806. The methodology 800 completes at 810.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. A detonator comprising:

a nonlinear transmission line having a capacitance that varies as a function of voltage on the nonlinear transmission line, the nonlinear transmission line configured to receive an input voltage pulse and compress the input voltage pulse to generate a trigger signal, the trigger signal having a predefined rise time and shape; and an igniter that ignites an explosive responsive to receiving the trigger signal from the nonlinear transmission line.

2. The detonator of claim 1, the igniter being one of a fuse or a bridge wire.

3. The detonator of claim 1, the nonlinear transmission line comprising a variable capacitor, wherein the variable capacitor is a lumped element in the nonlinear transmission line.

4. The detonator of claim 3, the variable capacitor having a plurality of layers, the plurality of layers comprising:

a first metal oxide layer;

a second metal oxide layer;

a third metal oxide layer;

a first dielectric layer; and a second dielectric layer, the first dielectric layer disposed between the first metal oxide layer and the second metal oxide layer, the second dielectric layer disposed between the second metal oxide layer and the third metal oxide layer.

5. The detonator of claim 4, the first metal oxide layer, the second metal oxide layer, and the third metal oxide layer being composed of zinc oxide.

6. The detonator of claim 4, the first dielectric layer and the second dielectric layer composed of a ceramic.

7. The detonator of claim 6, the ceramic being barium titanate.

8. The detonator of claim 4, wherein the first metal oxide layer, the second metal oxide layer, and the third metal oxide layer have equivalent widths, and wherein the first dielectric layer and the second dielectric layer have equivalent widths.

9. The detonator of claim 4, wherein the first metal oxide layer has a width that is different from a width of the second metal oxide layer or a width of the third metal oxide layer.

10. The detonator of claim 4, wherein the first metal oxide layer, the second metal oxide layer, the third metal oxide layer, the first dielectric layer, and the second dielectric layer are formed as concentric rings.

11. The detonator of claim 4, the nonlinear transmission line comprising a dielectric material, the dielectric material comprising conductive nanoparticles distributed therein, the dielectric material being a thermoset.

12. The detonator of claim 11, the conductive nanoparticles distributed with a varying density along a length of the nonlinear transmission line.

13. The detonator of claim 12, wherein distribution of the conductive nanoparticles is nonlinear.

14. A method for forming a detonator, the method comprising:

providing an igniter; and electrically connecting the igniter with a nonlinear transmission line that is configured to output a trigger signal that ignites the igniter, the nonlinear transmission line having a capacitance that varies as a function of voltage on the nonlinear transmission line, the nonlinear transmission line configured to receive a voltage pulse and compress the voltage pulse to generate the trigger signal.

15. The method of claim 14, the igniter being one of a fuse or a bridge wire.

16. The method of claim 14, the nonlinear transmission line comprising a variable capacitor, capacitance of the variable capacitor being based upon voltage on the variable capacitor.

17. The method of claim 16, the variable capacitor comprising a plurality of layers of metal oxide interposed between a respective plurality of layers of dielectric material.

18. The method of claim 16, the variable capacitor comprising a plurality of layers of ferroelectric material interposed between a respective plurality of layers of dielectric material.

19. The method of claim 16, the variable capacitor comprising a plurality of layers, the plurality of layers arranged as concentric rings.

20. A detonator comprising:

a nonlinear transmission line that comprises a variable capacitor as a lumped element, wherein a capacitance of the variable capacitor is dependent upon voltage on the variable capacitor, the capacitance decreases as the voltage on the capacitor increases, the nonlinear transmission line configured to receive a first voltage pulse having a first amplitude and a first pulse width and output a second voltage pulse having a second amplitude and a second pulse width, the second amplitude being greater than the first amplitude and the first pulse width being greater than the second pulse width; and an igniter that is electrically coupled to the nonlinear transmission line, the igniter configured to receive the second voltage pulse and detonate an explosive responsive to receipt of the second voltage pulse.

* * * * *